US010828521B2

(12) United States Patent
Libal et al.

(10) Patent No.: US 10,828,521 B2
(45) Date of Patent: Nov. 10, 2020

(54) FIRE EXTINGUISHING COMPOSITION

(71) Applicant: TYCO FIRE PRODUCTS LP, Lansdale, PA (US)

(72) Inventors: John Paul Libal, Peshtigo, WI (US); Jeffrey Harold Sunstrom, Marinette, WI (US); Stephen Aloysius Barker, Menominee, MI (US); Daniel Meyer, Marinette, WI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 14/776,199

(22) PCT Filed: Mar. 14, 2014

(86) PCT No.: PCT/US2014/027441

§ 371 (c)(1),
(2) Date: Sep. 14, 2015

(87) PCT Pub. No.: WO2014/152528

PCT Pub. Date: Sep. 25, 2014

(65) Prior Publication Data

US 2016/0030790 A1 Feb. 4, 2016

Related U.S. Application Data

(60) Provisional application No. 61/788,710, filed on Mar. 15, 2013.

(51) Int. Cl.
*A62D 1/00* (2006.01)

(52) U.S. Cl.
CPC ..... *A62D 1/0035* (2013.01); *A62D 1/005* (2013.01); *A62D 1/0014* (2013.01)

(58) Field of Classification Search
CPC ..... A62D 1/0035; A62D 1/0014; A62D 1/005
USPC ..... 169/47; 252/2, 5, 7
See application file for complete search history.

(56) References Cited

U.S. PATENT DOCUMENTS

| | | | | |
|---|---|---|---|---|
| 3,063,940 | A | 11/1962 | Cawood | |
| 3,895,759 | A * | 7/1975 | DePalma | A62C 31/00 169/74 |
| 4,652,383 | A | 3/1987 | Tarpley, Jr. et al. | |
| 4,909,328 | A * | 3/1990 | DeChant | A62C 11/00 169/30 |
| 5,053,147 | A | 10/1991 | Kaylor | |
| 5,055,208 | A | 10/1991 | Stewart et al. | |
| 5,062,996 | A | 11/1991 | Kaylor | |
| 5,332,524 | A | 7/1994 | Kaylor | |
| 5,425,426 | A | 6/1995 | Baratov et al. | |
| 5,518,075 | A | 5/1996 | Williams | |
| 5,833,874 | A | 11/1998 | Stewart et al. | |
| 8,336,637 | B2 | 12/2012 | Alsaffar | |
| 2010/0025054 | A1 * | 2/2010 | Jesclard | A62C 8/06 169/67 |

FOREIGN PATENT DOCUMENTS

| | | | |
|---|---|---|---|
| CN | 101792354 | A * | 8/2010 |
| CN | 101913965 | A * | 12/2010 |
| CN | 102949798 | A | 3/2013 |

OTHER PUBLICATIONS

International Search Report for International Application No. PCT/US2014/027441, dated Jul. 18, 2014 (3 pages).

PPG Industries Ohio, Inc., "FLO-GARD Precipitated Silica for Flow Conditioning, Anti-Caking and Carrier Applications", http://www.ppgsilica.com/Products/Flo-Gard.aspx, 3 pages.

* cited by examiner

*Primary Examiner* — Jason J Boeckmann
(74) *Attorney, Agent, or Firm* — Foley & Lardner LLP

(57) ABSTRACT

The present invention provides a fire extinguishing composition. The composition comprises monoammonium phosphate and potassium chloride. In one embodiment, the composition comprises a weight percentage of monoammonium phosphate in a range of between about 51% and about 99%, and a weight percentage of potassium chloride in a range of between about 1% and about 49%.

19 Claims, 1 Drawing Sheet

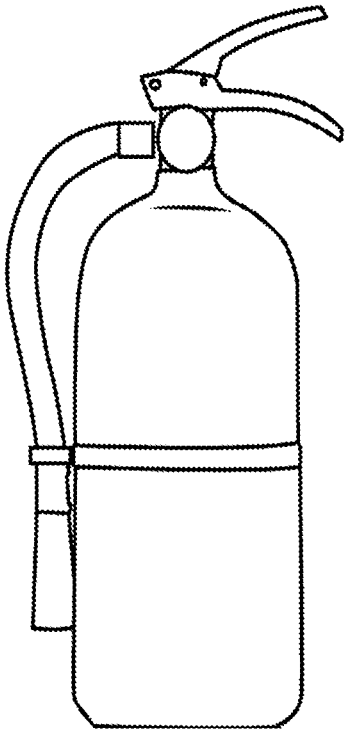
(Prior Art)

FIRE EXTINGUISHING COMPOSITION

CROSS-REFERENCE TO RELATED APPLICATIONS

This application is a 371 national phase of PCT/US2014/027441, filed Mar. 14, 2014, and claims the benefit of U.S. Provisional Application No. 61/788,710 filed Mar. 15, 2013, the entire contents of which are hereby incorporated by reference.

TECHNICAL FIELD

This invention is directed to fire extinguishing compositions. More particularly, this invention provides fire extinguishing compositions comprising monoammonium phosphate and potassium chloride.

BACKGROUND

Fire extinguishing agents are often characterized in terms of the type of fire they are used to extinguish. For example, in the United States, Class A fires are characterized as ordinary solid combustibles; Class B fires are characterized as flammable liquids and gasses; and Class C fires are characterized as originating from electrical current. Not all fire extinguishing agents are suitable for all fire types. For example, liquid agents are not well suited for extinguishing fires of an electrical origin.

Dry powder fire extinguishing agents in commercial use are of two principal types. The first type is represented by sodium bicarbonate, potassium bicarbonate, ammonium borate, potassium borate, sodium borate (borax), sodium sulfate, sodium phosphate, sodium polyphosphate, sodium chloride, potassium chloride and the like. The agents of the first type are generally used on Class B and C fires. Among these agents, sodium bicarbonate and potassium bicarbonate are widely used. The performance of potassium chloride on Class B fires is inferior to that of potassium and sodium bicarbonate. Some research shows that potassium chloride works at reducing the size of a large fire. When the relative size and heat density of a fire is reduced, however, potassium chloride loses effectiveness, and the remaining small flames can reignite the fuel.

The second type of fire-extinguishing agents may be represented by monoammonium phosphate (MAP), ammonium polyphosphate and the like. MAP can be used on Class A, B, and C fires. Although MAP works well on Class A fires, it is a relatively expensive chemical. Further, MAP has poor to modest extinguishing characteristics for Class B fires.

SUMMARY

In one aspect, a fire extinguishing composition includes monoammonium phosphate and potassium chloride. In some embodiments, the weight percentage of monoammonium phosphate is in a range of between about 51% and about 99%, and the weight percentage of potassium chloride is in a range of between about 1% and about 49%. In some embodiments, the weight percentage of monoammonium phosphate is in a range of between about 65% and about 75%, and the weight percentage of potassium chloride is in a range of between about 25% and about 35%. In some embodiments, the composition also includes one or more additives selected from the group consisting of clay, poly (methylhydrogen)siloxane, water, silica, mica, ammonium sulfate, and combinations thereof. In some embodiments, the monoammonium phosphate and potassium chloride are in the form of powder. In some embodiments, the powder has an average particle diameter of from about 10 to about 100 μm. In some embodiments, the powder is siliconized.

In another aspect, a fire extinguishing composition consists essentially of monoammonium phosphate and potassium chloride. In some embodiments, the weight percentage of monoammonium phosphate is in a range of between about 51% and about 99%, and the weight percentage of potassium chloride is in a range of between about 1% and about 49%. In some embodiments, the total weight percentage of monoammonium phosphate and potassium chloride is more than about 90%.

In another aspect, a method of extinguishing a fire is disclosed. The method includes applying a composition to the fire, wherein the composition having monoammonium phosphate and potassium chloride as further described herein.

In another aspect, a fire extinguisher is disclosed. The fire extinguisher has a composition of monoammonium phosphate and potassium chloride as further described here.

BRIEF DESCRIPTION OF THE DRAWINGS

The FIGURE shows a Drier art depiction of a fire extinguisher.

DETAILED DESCRIPTION OF THE INVENTION

This invention relates generally to fire extinguishing compositions comprising monoammonium phosphate (MAP) and potassium chloride.

MAP is a mild acid and the resulting chemical reaction when mixed with potassium and sodium bicarbonate reduces the effectiveness of the extinguishing material and may even render the extinguishing agent inert. Potassium chloride is neutral and can be mixed with MAP without chemical reaction. The cost of potassium chloride is typically lower than that of MAP.

The present disclosure provides a fire extinguishing composition comprising MAP and potassium chloride. The weight percentage of MAP in the composition can be in a range of between about 50% and about 99%. The weight percentage of potassium chloride in the composition can be in a range of between about 1% and about 49%. In some embodiments, the weight percentage of MAP is about 65%-75%, and the weight percentage of potassium chloride is about 25%-35%. In one embodiment, the composition comprises about 70% of weight percentage of MAP and about 25% of potassium chloride. In another embodiment, the weight percentage of MAP is about 70% and the weight percentage of potassium chloride is about 20%. In one embodiment, the total weight percentage of MAP and potassium chloride can be more than 90%.

In one embodiment, the composition consists essentially of MAP and potassium chloride. The weight percentage of MAP in the composition can be in a range of between about 50% and about 99%. The weight percentage of potassium chloride in the composition can be in a range of between about 1% and about 49%. In some embodiments, the weight percentage of MAP is about 65%-75%, and the weight percentage of potassium chloride is about 25%-35%. In one embodiment, the composition comprises about 70% of weight percentage of MAP and about 25% of potassium chloride. In another embodiment, the weight percentage of MAP is about 70% and the weight percentage of potassium chloride is about 20%. In one embodiment, the total weight percentage of MAP and potassium chloride can be more than 90%.

The composition of the present disclosure can further comprise other additives, such as moist absorbers, flow agents, fillers, and pigments. These additives can be any suitable agents known in the art. For example, clay, poly (methylhydrogen)siloxane, water, silica, fumed silica, mica, ammonium sulfate, yellow pigments (complied with NFPA color requirements) and the combination of these additives can be used in the present composition without substantially changing the properties of the MAP and potassium chloride composition and the composition's effectiveness in extinguishing different classes of fires.

In one embodiment, MAP and potassium chloride are in the form of powders. In some embodiments, the particle size of the powder is in a range of between about 0.05 μm and about 300 μm. In some embodiments, the average particle size is between about 10 μm to about 100 μm. MAP and potassium chloride powders can be obtained from many suitable processes. In one embodiment, MAP and potassium chloride are ground in a mill to obtain the powder of appropriate particle size. The powders are further siliconized in a powder blender. MAP and potassium chloride powders can be siliconized by any suitable siliconization processes. Then, siliconized powders can be mixed with other additives to provide the inventive compositions.

The present disclosure also provides a method to extinguish a fire, including Class A, B, and C fires. The method comprises applying the composition of the present disclosure to a fire. For example, the composition comprises MAP and potassium chloride. The weight percentage of MAP in the composition can be in a range of between about 50% and about 99%. The weight percentage of potassium chloride in the composition can be in a range of between about 1% and about 49%. In some embodiments, the weight percentage of MAP is about 65%-75%, and the weight percentage of potassium chloride is about 25%-35%. In one embodiment, the composition comprises about 70 weight percent of MAP and about 25 weight percent of potassium chloride. In another embodiment, the weight percentage of MAP is about 70%, and the weight percentage of potassium chloride is about 20%. In one embodiment, the total weight percentage of MAP and potassium chloride can be more than 90%.

The present disclosure also includes a fire extinguisher having the compositions described herein. The fire extinguisher can include any suitable container. The composition of the fire extinguisher comprises MAP and potassium chloride. The weight percentage of MAP in the composition can be in a range of between about 50% and about 99%. The weight percentage of potassium chloride in the composition can be in a range of between about 1% and about 49%. In some embodiments, the weight percentage MAP is about 65%-75%, and the weight percentage of potassium chloride is about 25%-35%. In one embodiment, the composition comprises about 70 weight percent of MAP and about 25 weight percent of potassium chloride. In another embodiment, the weight percentage of MAP is about 70%, and the weight percentage of potassium chloride is about 20%. In one embodiment, the total weight percentage of MAP and potassium chloride can be more than 90%.

The following examples describe the manner and process of making and using the compositions of the present disclosure.

Fire extinguishing capacity can be rated according to widely known industry standards, for example ANSI/UL 711: Rating and Fire Testing of Fire Extinguishers. The ANSI/UL 711 ratings are described using numbers preceding the class letter, such as 1-A:10-B:C. The number preceding the A multiplied by a factor of 1.25 gives the equivalent extinguishing capability in gallons of water. The number preceding the B indicates the size of fire in square feet that an ordinary user should be able to extinguish. There is no additional rating for Class C, as it only indicates that the extinguishing agent will not conduct electricity, and an extinguisher will never have a rating of just C.

All performance testing was done according to UL711.

Composition 1

| INGREDIENT | WT % |
|---|---|
| MAP | 68.99 |
| Potassium Chloride | 23 |
| ATTAPULGITE CLAY | 4.93 |
| MICA | 1.64 |
| SILICONE | 0.78 |
| YELLOW PIGMENT | 0.016 |
| FLO-GARD | 0.66 |
| WATER | 0.0006 |

Comparative Composition 2 (Control)

| INGREDIENT | WT % |
|---|---|
| MAP | 91.99 |
| ATTAPULGITE CLAY | 4.93 |
| MICA | 1.64 |
| SILICONE | 0.78 |
| YELLOW PIGMENT | 0.016 |
| FLO-GARD | 0.66 |
| WATER | 0.0006 |

Composition 1 includes MAP, potassium chloride, and other additives. Composition 2 includes MAP and other additives. According to the testing results, composition 1 maintained Class A, B, and C performance as an extinguishing agent while being less expensive compared to conventional extinguishing compositions. Furthermore, because potassium chloride has Class B performance, composition 1 retained or improved Class B performance. Without wishing to be bound by any theory, this may be accomplished by the combination of potassium chloride and MAP extinguishes a large fire into small flames and then MAP is able to extinguish the remaining small flames.

Many modifications and other embodiments of the present disclosure will come to mind to one skilled in the art to which the present disclosure pertains having the benefit of the teachings presented in the foregoing description, and it will be apparent to those skilled in the art that variations and modifications of the present disclosure can be made without departing from the scope or spirit of the present disclosure. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A fire extinguisher comprising a dry powder fire extinguishing composition contained therewithin, the dry powder fire extinguishing composition consisting of;

65 to 75 wt % monoammonium phosphate and 20 to 35 wt % potassium chloride, wherein a total weight percent of the monoammonium phosphate and potassium chloride is at least 90 wt % of the composition; and one or more of attapulgite clay, mica, silica and silicone; and water;

wherein the fire extinguishing composition does not include ammonium sulfate.

2. The fire extinguisher of claim 1, wherein the dry powder fire extinguishing composition contains attapulgite clay, mica and silica.

3. The fire extinguisher of claim 1, wherein the dry powder fire extinguishing composition is siliconized and has an average particle diameter of 10 μm- 100 μm.

4. A method of extinguishing a fire comprising applying the dry powder fire extinguishing composition of claim 1 to the fire.

5. The fire extinguisher of claim 1, wherein the dry powder fire extinguishing composition consists of monoammonium phosphate, potassium chloride, water, attapulgite clay, mica, silicone and silica.

6. The fire extinguisher of claim 1, wherein the monoammonium phosphate and potassium chloride are in the form of a dry powder having an average particle diameter of 0.5 μm to 300 μm.

7. The fire extinguisher of claim 1, wherein the monoammonium phosphate and potassium chloride are in the form of a siliconized dry powder.

8. The fire extinguisher of claim 7, wherein the siliconized dry powder has an average particle diameter of 10 μm- 100 μm.

9. The fire extinguisher of claim 8, wherein the dry powder fire extinguishing composition consists of monoammonium phosphate, potassium chloride, water, attapulgite clay, mica, silicone and silica.

10. A method of extinguishing a fire comprising applying the dry powder fire extinguishing composition of claim 9 to the fire.

11. The fire extinguisher of claim 1, wherein the dry powder fire extinguishing composition contains:

65 to 70 wt % monoammonium phosphate;

20 to 25 wt % potassium chloride; and clay, mica, silica and pigment;

wherein the monoammonium phosphate and potassium chloride are in the form of a dry powder having an average particle diameter of 0.5 μm to 300 μm.

12. A method of extinguishing a fire comprising applying the dry powder fire extinguishing composition of claim 11 to the fire.

13. A fire extinguisher comprising a dry powder fire extinguishing composition contained therewithin, the dry powder fire extinguishing composition consisting of:

65 to 75 wt % monoammonium phosphate;

20 to 35 wt % potassium chloride; and at least one of clay; mica; silica; pigment; silicone; and water;

wherein the dry powder fire extinguishing composition has an average particle diameter of 10 μm 100 μm and does not include ammonium sulfate; and a total combined weight percent of the monoammonium phosphate and the potassium chloride is at least 90 wt % of the composition.

14. The fire extinguisher of claim 13, wherein the dry powder fire extinguishing composition contains clay, mica, silica and pigment.

15. The fire extinguisher of claim 14, wherein the dry powder fire extinguishing composition contains:

65 to 70 wt % monoammonium phosphate; and 20 to 25 wt % potassium chloride.

16. The fire extinguisher of claim 13, wherein the dry powder fire extinguishing composition is siliconized.

17. A method of extinguishing a fire comprising applying the dry powder fire extinguishing composition of claim 13 to the fire.

18. The fire extinguisher of claim 13, wherein the dry powder fire extinguishing composition consists of monoammonium phosphate, potassium chloride, water, attapulgite clay, mica, silicone and silica;

wherein the composition contains 65 to 70 wt % of the monoammonium phosphate; and 20 to 25 wt % of the potassium chloride; and the monoammonium phosphate and potassium chloride are in the form of a siliconized dry powder.

19. A method of extinguishing a fire comprising applying the dry powder fire extinguishing composition of claim 18 to the fire.

* * * * *